United States Patent [19]

Gabarro

[11] 4,149,628

[45] Apr. 17, 1979

[54] ARTISTS PAINTBOXES

[76] Inventor: Carl R. Gabarro, 60 Belsize Ave., Hampstead, London, England

[21] Appl. No.: 796,154

[22] Filed: May 12, 1977

[30] Foreign Application Priority Data

May 13, 1976 [GB] United Kingdom ..... 19783/76

[51] Int. Cl.[2] ..... B44D 3/00; B65D 1/34

[52] U.S. Cl. ..... 206/1.7; 206/361; 206/557; 206/558; 206/561; 220/4 C

[58] Field of Search ..... 206/1.7–1.9, 206/209, 361, 546–547, 557–559, 561, 565, 568, 577; 220/4 C, 4 D, 4 F, 17, 23.4, 23.83, 23.86, 20

[56] References Cited

U.S. PATENT DOCUMENTS

| | | | |
|---|---|---|---|
| 1,535,954 | 4/1925 | Smith | 206/547 |
| 1,699,388 | 1/1929 | Beindorff | 206/1.8 X |
| 1,809,596 | 6/1931 | Nason | 206/547 X |
| 3,077,977 | 2/1963 | Wood | 206/1.7 |
| 3,389,945 | 6/1968 | Thomas | 206/1.7 X |
| 3,983,993 | 10/1976 | Hsu et al. | 206/1.7 |

*Primary Examiner*—Steven E. Lipman
*Attorney, Agent, or Firm*—Rose & Edell

[57] ABSTRACT

A combined artists paintbox and a liquid container, comprising a tray for housing the paints and brushes and a sealable liquid container hinged thereto. The liquid container is pivotable from an open position, providing access to the paints in the tray, to a closed position covering the open side of the tray. A separate liquid container is provided which can be supported by the tray or sealable liquid container when in their open position and which is used to hold the liquid poured from the sealable container. The separate liquid container is also made to fit over the tray and sealable liquid container to hold them in a closed position.

11 Claims, 6 Drawing Figures

ARTISTS PAINTBOXES

This invention relates to an improved artists paintbox and more particularly to a combined artists paintbox and a liquid container.

BACKGROUND OF THE INVENTION

Portable paintboxes, intended for carrying on the person, are already known but these have the disadvantage that the artists has to carry a separate container for the liquid e.g. water to mix the paints.

An aim of the present invention is to provide a combined artists paintbox and liquid container comprising a tray for housing the paints, a sealable liquid container hinged thereto, the liquid container being pivotable from an open position, providing access to the paints in the tray, to a closed position covering the open side of the tray, at least one palette for mixing the paints and a separate liquid container slidable over the tray, palette and sealable liquid container to hold them in the closed position, the separate liquid container having means to secure it to the tray or sealable liquid container when in their open position.

In a preferred construction an inside wall of the tray is provided with resilient means to hold the paints in the tray. The tray may also be provided with dividing members engageable with the resilient means to separate the paints into rows and help retain them in position when the combined paintbox and liquid container is carried.

BRIEF DESCRIPTION OF THE DRAWINGS

An embodiment of the combined paintbox and liquid container will now be described by way of example, with reference to the accompanying drawings, in which.

DESCRIPTION OF THE PREFERRED EMBODIMENT

Figure 1:
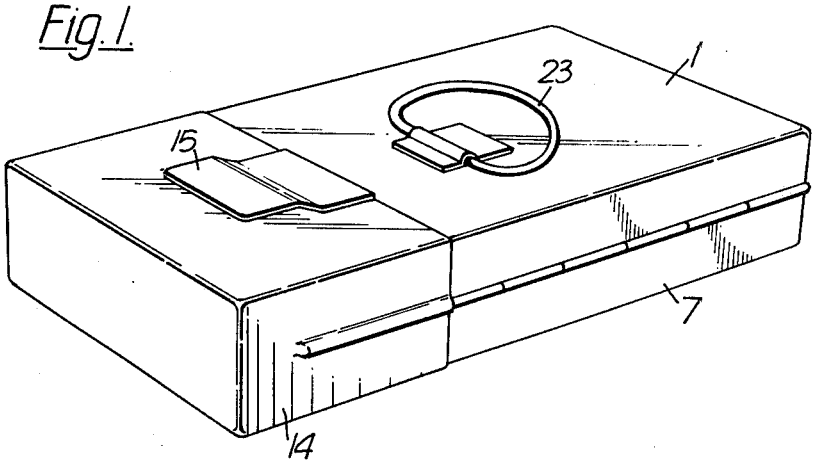
FIG. 1 is a perspective view of the combined paintbox and liquid container in the closed position according to the invention.

Referring now to the drawings in detail the combined artists paintbox and liquid container is made of metal, preferably brass, and comprises a tray 1 housing fifteen half-pans of water colour paints 2. These paints are separate from one another and are held in place in the tray by dividing members 3 formed from strips bent into a V-shape with outwardly projecting portions 4 at their upper edges which engage adjacent rows of paints. The dividing members 3 are themselves retained in the paintbox tray by two resilient leaf springs 5 fixed to an inside end wall of the tray. The upper projecting portions 4 of each dividing member 3 are provided with a gripping means 6 to enable the members 3 to be gripped and pushed against the leaf springs 5 to remove the members 3 from the tray thus enabling a used pan of paint to be replaced.

In an alternative construction the leaf springs 5 are replaced by a single strip of spring metal which is dimensioned to be self positioning in the tray 1. This alternative construction simplifies the assembly of the tray and facilitates removal of the dividing members 3 and hence the removal of the pans of paint.

Hinged to one longitudinal edge of the tray 1 is a sealable liquid container 7 provided with two holes 8 enabling the container to be filled with a liquid and for the liquid to be subsequently poured from the container. The two holes 8 are sealed by rubber domed-shaped washers 9, fitted in holes in a plate 10. The washers are pressed against the holes 8, to seal them, by means of a knurled nut 11 threaded onto a rod 12 secured to one end wall of the container and which rod passes through a hole 13 formed in the middle of the plate 10.

The combined paintbox and liquid container also includes a separate liquid container 14 having a clip 15 fixed thereto. In use the container 14 is removably fitted to the tray 1 by sliding the clip 15 in a bracket 16 fixed to the outside of one end wall of the tray. The container 14 is made to fit, with a sliding fit, over the paintbox and liquid container in their closed position, as shown in FIG. 1 and is provided with two internal brackets 17 which engage the end wall of the closed paintbox and liquid container supporting it clear of the threaded rod 12 and nut 11.

Figure 3:
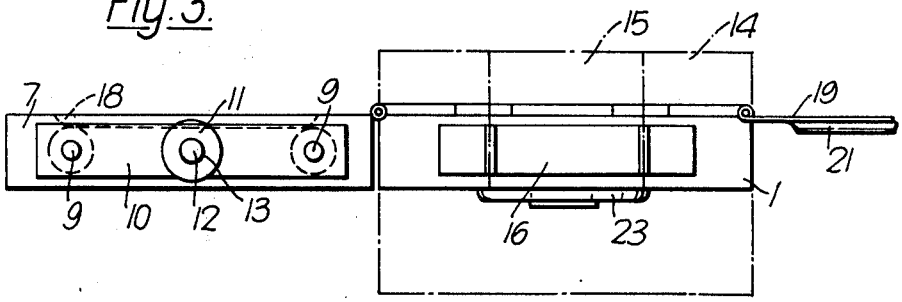
FIG. 3 is an end view of the paintbox and liquid container shown in FIG. 2.
Figure 2:
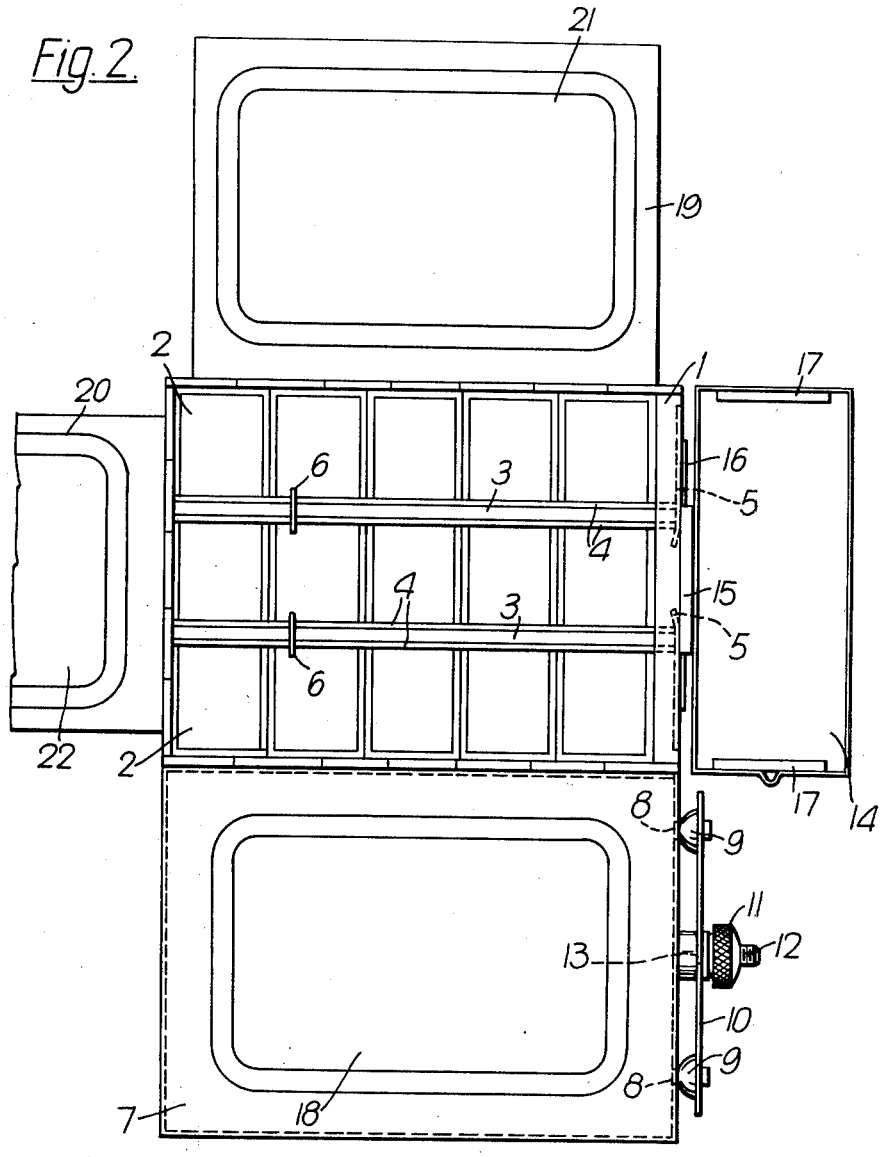
FIG. 2 is a plan of the combined paintbox and liquid container of FIG. 1 the open position ready for use.

The upper surface of the sealable liquid container 7 is provided with a dished portion 18, see also FIG. 3, in the form of a palette for mixing the paints. Two further palettes 19 and 20 may also be provided, which are hinged to the side and end walls of the tray opposite the sealable and separate liquid containers respectively. These palettes 19 and 20 are also formed with dished portions 21 and 22 respectively which interfit with each other and with the dished portion 18 when pivoted to a closed position adjacent the open side of the tray 1. The underside of the paintbox tray 1 is fitted with a pivotable ring 23 which is used as a thumb ring when supporting the tray in the position of use. This ring can be pivoted to lie flat against the underside of the tray when in the closed position.

In use the separate liquid container 14 is removed from the combined paintbox and sealable liquid container 7 and the knurled nut 11 is unscrewed allowing the plate 10 to be pivoted about the threaded rod 12 uncovering the holes 8. The container 7, in the present embodiment is filled with water which is poured into the container 14 and the plate and washers are pivoted covering up the holes and the knurled nut is tightened re-sealing the container 7. The artist holds the paintbox in one hand sliding his thumb into the ring 23 and the sealable water container is pivoted about its hinge away from the tray while the separate liquid container is supported on the tray by sliding the clip 15 into the bracket 16. The palettes 19 and 20 are then pivoted about their hinges to the open position uncovering the paints in the tray and the artists can thus support the combined paintbox, water containers and palettes easily in one hand while his other hand is free to hold the paintbrush. It will be obvious that the three palettes can be used to mix different colours using the water from the container 14.

Figure 4:
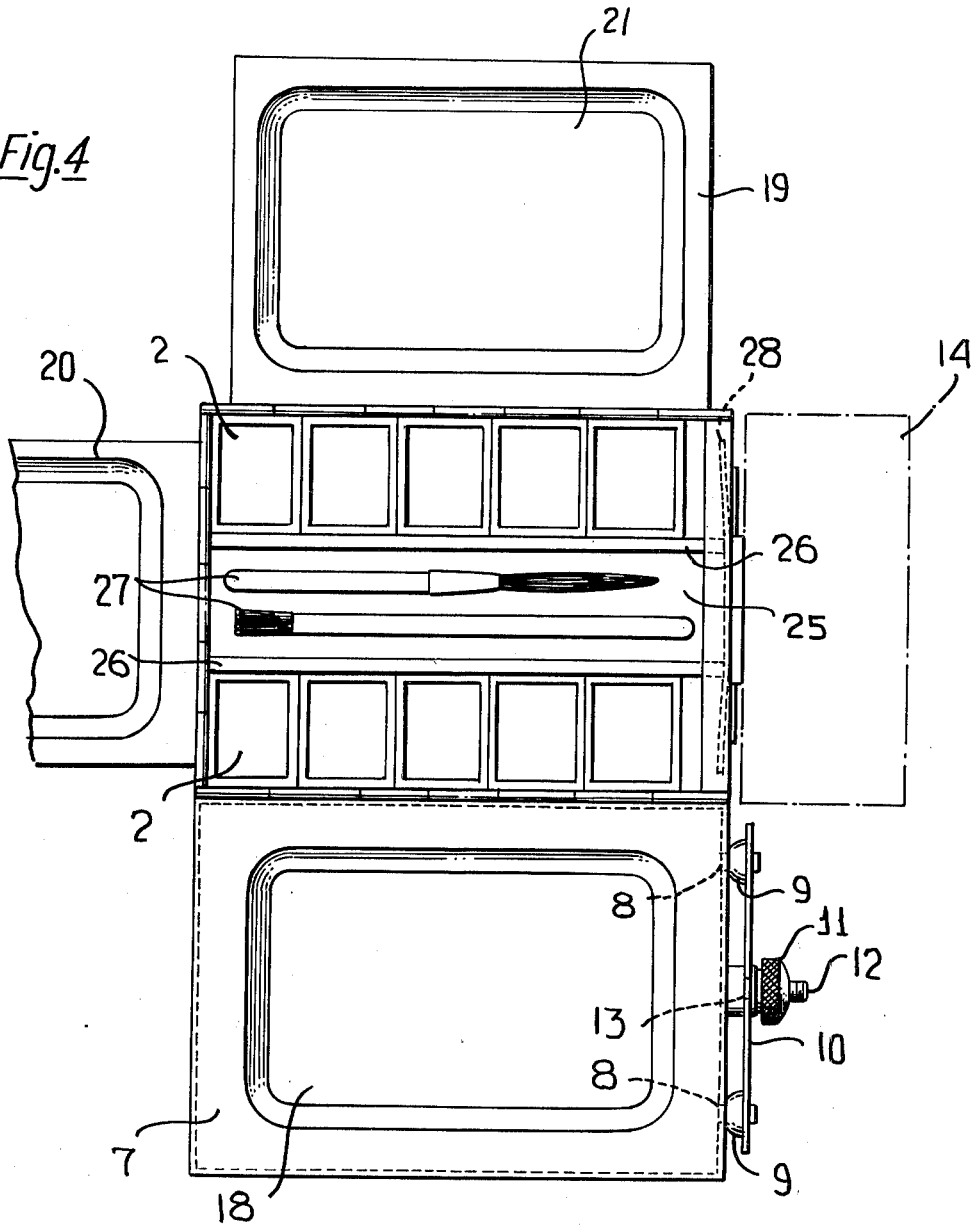
FIG. 4 is a plan view of a modified combined paintbox and liquid container.
Figure 6:
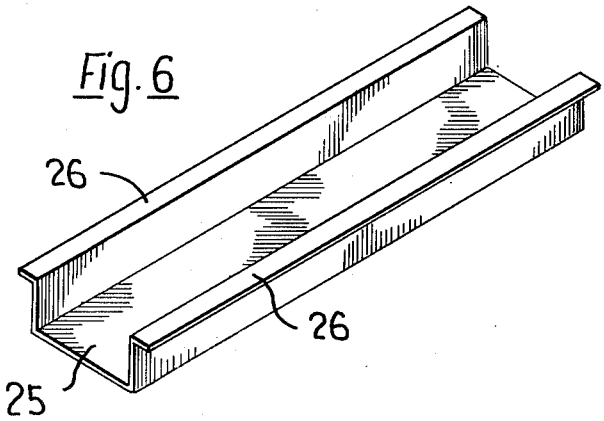
FIG. 6 is a view in perspective of a channel shaped strip employed in the embodiment of FIG. 4.
Figure 5:
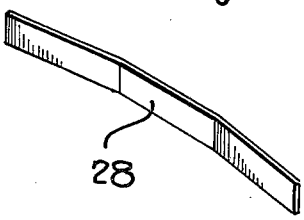
FIG. 5 is a view in perspective of a leaf spring employed in the embodiment of FIG. 4.

As an addition to the paintbox as illustrated in FIGS. 4, 5 and 6, a channel shaped strip 25 of material, e.g. metal or plastics, having a U-shaped cross-section with outwardly projecting flanges 26 is provided. This channel shaped strip 25 is used as a spacer and can replace one of the rows of half-pans of water colour paints 2. This would mean that in the example illustrated in FIG. 4, there would be ten half-pans of water colour paints instead of fifteen. The channel shaped spacer would thus form a compartment for the storage of collapsible paint brushes 27 when not in use. The two leaf springs 5 would be replaced by a single leaf spring 28 to retain channel-shaped strip 25 in place.

Although the illustrated embodiment of the paintbox has been described for use with water colours with the liquid container carrying water, it will be apparent that it could equally well be adapted for use with oil paints. In this embodiment the tray would house small tubes of oil paint and the sealable liquid container 7 could be adapted to contain turpentine and linseed oil in separate compartments. Similarly, the separate container could be provided with a dividing wall to enable turpentine and linseed oil to be poured into the respective compartments.

Various modifications can be made to the invention, for example, instead of being made of metal the combined paintbox and liquid container can be made of a suitable plastics material. The hinged palettes 19 and 20 can also be modified to slide in grooves in the sides of the tray instead of being hinged thereto.

I claim:

1. A combined artist's paintbox and liquid container comprising:

a tray for housing paints;

a first liquid container;

means for selectively sealing said liquid container;

at least one palette secured to said tray for mixing paints;

a second liquid container which is readily separable from said tray;

hinge means engaging said first liquid container to said tray to permit said first liquid container to be pivoted between first and second extreme positions, said first position corresponding to an open position in which free access is provided to paints housed in said tray, said second position corresponding to a closed position in which said first liquid container covers said paints housed in said tray;

means for removably securing said second liquid container to said paint box when said first liquid container is in said open position; and wherein said second liquid container is slidable over both said tray and said first liquid container when said first liquid container is in said closed position to secure said first liquid container in said closed position.

2. A combined artists paintbox and liquid container, according to claim 1, wherein said first liquid container defines two apertures, and further comprises a washer closing each aperture, a plate carrying said washer, and a threaded nut and rod securing said plate to said first liquid container to seal said apertures when said nut is tightened on said rod.

3. A combined artists paintbox and liquid container, according to claim 2, wherein resilient means are provided in said tray to hold said paints in said tray.

4. A combined artists paintbox and liquid container, according to claim 3, wherein said resilient means are formed by two leaf springs fixed to an inside wall of said tray.

5. A combined artists paintbox and liquid container according to claim 3, wherein dividing members are provided in said tray, said dividing members engaging said resilient means to separate said paints into rows and retain them in position when carried.

6. A combined artists paintbox and liquid container, according to claim 3, wherein said resilient means are formed by a strip of spring metal dimensioned to be self positioning in said tray.

7. A combined artists paintbox and liquid container, according to claim 5, wherein a channel shaped strip is fitted in said tray to accommodate paint brushes.

8. A combined artists paintbox and liquid container, according to claim 1, wherein said palette is formed by a dished portion of said first liquid container which is exposed in the open position of said first liquid container.

9. A said artists paintbox and liquid container, according to claim 8, including two further palettes, which are formed by flaps, having dished portions, hinged to the side and one end wall of said tray respectively.

10. A combined artists paintbox and liquid container, according to claim 8, including two further palettes which are formed by flat plate membes, having dished portions, which slide in grooves formed in opposite side walls of said tray respectively.

11. A combined artists paintbox and liquid container, according to claim 1, further comprising a clip on said second liquid container and a bracket on said tray, said clip engaging said bracket to support said second liquid container when in use.

* * * * *